US009533189B2

(12) United States Patent
Cameron

(10) Patent No.: US 9,533,189 B2
(45) Date of Patent: Jan. 3, 2017

(54) PUSH-UP EXERCISE APPARATUS

(71) Applicant: Jaime Cameron, Mississauga (CA)

(72) Inventor: Jaime Cameron, Mississauga (CA)

( * ) Notice: Subject to any disclaimer, the term of this patent is extended or adjusted under 35 U.S.C. 154(b) by 0 days.

(21) Appl. No.: 14/130,303

(22) PCT Filed: May 29, 2013

(86) PCT No.: PCT/CA2013/050414

§ 371 (c)(1),
(2) Date: Dec. 30, 2013

(87) PCT Pub. No.: WO2013/177709

PCT Pub. Date: Dec. 5, 2013

(65) Prior Publication Data

US 2015/0072843 A1 Mar. 12, 2015

Related U.S. Application Data

(60) Provisional application No. 61/653,354, filed on May 30, 2012.

(51) Int. Cl.
*A63B 21/068* (2006.01)
*A63B 71/00* (2006.01)
(Continued)

(52) U.S. Cl.
CPC ..... *A63B 23/1236* (2013.01); *A63B 17/04* (2013.01); *A63B 21/169* (2015.10);
(Continued)

(58) Field of Classification Search
CPC . A63B 21/4029; A63B 23/12; A63B 23/1218; A63B 23/1227; A63B 23/1209; A63B 23/1236;A63B 17/00; A63B 21/00047; A63B 21/068; A63B 1/00; A63B 3/00; A63B 2009/006; A63B 23/0458; A63B 23/0464
(Continued)

(56) References Cited

U.S. PATENT DOCUMENTS 176,074 A * 4/1876 Schneider ..... E06C 1/32
182/228.1
524,661 A * 8/1894 Austin ..... E06C 1/345
182/156

(Continued)

OTHER PUBLICATIONS

International Search Report for International Application No. PCT/CA2013/050414 mailed Aug. 28, 2013.

*Primary Examiner* — Oren Ginsberg
*Assistant Examiner* — Nyca T Nguyen
(74) *Attorney, Agent, or Firm* — Knobbe, Martens, Olson & Bear LLP

(57) ABSTRACT

Described herein is a push-up exercise apparatus. The push-up exercise apparatus includes a frame having at least a pair of legs and transverse cross braces connecting the legs; a plurality of horizontal platforms coupled to the frame and transverse to the at least pair of the legs; a plurality of horizontal bars coupled the frame and transverse to the at least pair of the legs; and the plurality of horizontal platforms and bars arranged in a stepped configuration such that an upper bar is recessed compared to a lower bar and/or one or more of the plurality of horizontal platforms or bars being slidably coupled to the frame. Methods for performing push-ups are also described.

20 Claims, 14 Drawing Sheets

(51) Int. Cl.

| | |
|---|---|
| ***A63B 23/12*** | (2006.01) |
| ***A63B 17/04*** | (2006.01) |
| ***A63B 23/02*** | (2006.01) |
| *A63B 21/055* | (2006.01) |
| *A63B 71/02* | (2006.01) |

(52) U.S. Cl.
CPC ..... *A63B 21/4029* (2015.10); *A63B 23/0216* (2013.01); *A63B 23/1218* (2013.01); *A63B 21/0552* (2013.01); *A63B 2071/024* (2013.01); *A63B 2210/50* (2013.01); *A63B 2210/56* (2013.01)

(58) Field of Classification Search
USPC ..... 182/21, 22, 23, 26, 194
See application file for complete search history.

(56) References Cited

U.S. PATENT DOCUMENTS

| | | | | | |
|---|---|---|---|---|---|
| 1,148,882 | A * | 8/1915 | Wood | E06C 1/32 | 182/216 |
| 1,936,508 | A * | 11/1933 | Hanly | E06C 1/32 | 182/228.1 |
| 2,433,699 | A * | 12/1947 | Keen | A47C 12/02 | 182/33.5 |
| 2,862,650 | A * | 12/1958 | Scott | E06C 7/08 | 182/194 |
| 3,472,509 | A * | 10/1969 | Flynn | A63B 17/00 | 182/129 |
| 3,476,211 | A * | 11/1969 | Cormier | E06C 1/10 | 182/178.2 |
| 3,912,043 | A * | 10/1975 | Brannan | E06C 1/32 | 182/23 |
| 4,109,961 | A * | 8/1978 | Opsvik | A47C 3/20 | 108/110 |
| 4,826,151 | A | 5/1989 | Nuredin | | |
| 5,033,741 | A | 7/1991 | Ganzer | | |
| 5,088,420 | A * | 2/1992 | Russell | A47B 21/00 | 108/106 |
| 5,697,875 | A | 12/1997 | Stan | | |
| 6,050,926 | A | 4/2000 | Purdie | | |
| 6,129,651 | A | 10/2000 | Denaro | | |
| 7,060,014 | B2 | 6/2006 | Bergman et al. | | |
| 7,318,793 | B2 | 1/2008 | Dubrul et al. | | |
| 7,588,521 | B1 | 9/2009 | Fazzari | | |
| 2001/0004624 | A1* | 6/2001 | Cournoyer | A63B 23/12 | 482/141 |
| 2009/0124464 | A1* | 5/2009 | Kastelic | A63B 17/04 | 482/52 |
| 2009/0124471 | A1 | 5/2009 | Storch | | |
| 2011/0124476 | A1 | 5/2011 | Holley | | |
| 2012/0175189 | A1* | 7/2012 | Stewart | E06C 7/46 | 182/111 |
| 2013/0237394 | A1* | 9/2013 | Fowler | A63B 17/00 | 482/142 |
| 2014/0315700 | A1* | 10/2014 | Stallman | A63B 21/00047 | 482/141 |

* cited by examiner

PUSH-UP EXERCISE APPARATUS

CROSS REFERENCE TO RELATED APPLICATIONS

This application is the U.S. National Phase of International Application No. PCT/CA2013/050414, filed May 29, 2013, designating the U.S. and published as WO 2013/177709 on Dec. 12, 2013 which claims the benefit of U.S. Provisional Application No. 61/653,354, filed May 30, 2012.

BACKGROUND OF THE INVENTION

Field of the Invention

The present invention relates to exercise equipment, more specifically exercise equipment that can be used to perform push-ups.

Description of the Related Art

A push-up (or the British term press-up) is one of the most widely performed free weight exercise. A standard push-up is performed by placing hands and feet on a flat surface with the back and legs maintained in a straight or plank position with arms fully extended. Arms are bent to bring the torso to the ground and then arms are extended to complete the push-up.

The standard push-up is not suitable for all exercise programs. For example, individuals rehabilitating an injury or simply lacking in upper body strength may not be able to perform a standard push-up. Conversely, highly athletic individuals may find that a standard push-up does not sufficiently challenge their muscles.

Various modifications of the standard push-up have been developed to either increase or decrease the physical challenge of the push-up.

Decline push-ups, diamond push-ups, wide-grip push-ups, Maltese push-ups, Chinese or Hindu push-ups, knuckle push-ups, one armed push-ups, guillotine push-ups, back-handed push-ups and walking push-ups are examples of modified push-ups that require increased effort to perform compared to a standard push-up.

Incline push-ups, knee push-ups, and three-phase push-ups are examples of modified push-ups that require less effort to perform compared to a standard push-up.

Furthermore, several push-up exercise devices have been developed with the goal of increasing and/or decreasing the physical challenge of the standard push-up. Examples of such devices are disclosed in U.S. Pat. Nos. 5,033,741; 6,050,926; 7,060,014; 7,318,793; 7,114,352; and 7,588,521. Despite the availability of many such devices, none have achieved popularity in the health club industry.

In commercial gyms the most popular method for achieving a variance of push-ups is to find open space/walls or gym equipment that one can lean into or put their feet up on. This does not always allow for the same stable function, and this improvised method can compromise proper form.

Accordingly, there is a continuing need for devices that allow users to perform a variety of modified push-ups.

SUMMARY OF THE INVENTION

In an aspect there is provided a push-up exercise apparatus comprising:

a frame comprising at least 3 vertical legs and transverse cross braces connecting the legs;

the frame having a horizontal cross-section of at least 3 sides;

a plurality of horizontal platforms coupled to a first side of the frame and transverse to a first pair of the legs;

the plurality of horizontal platforms having a stepped configuration such that an upper platform is recessed compared to a lower platform;

a plurality of horizontal bars coupled to a second side of the frame and transverse to a second pair of the legs; and the plurality of horizontal bars having a stepped configuration such that an upper bar is recessed compared to a lower bar.

In another aspect there is provided a push-up exercise apparatus comprising:

a frame comprising at least 3 vertical legs and transverse cross braces connecting the legs;

the frame having a horizontal cross-section of at least 3 sides;

at least one horizontal platform coupled to a first side of the frame and transverse to a first pair of the legs;

at least one horizontal bar coupled to a second side of the frame and transverse to a second pair of the legs;

the at least one horizontal platform having a largest dimension greater than 25 inches and a load bearing capacity of at least 100 pounds; and the at least one horizontal bar having a largest dimension greater than 25 inches and a load bearing capacity of at least 100 pounds.

In yet another aspect there is provided a push-up exercise apparatus comprising:

a frame comprising at least two legs and transverse cross braces connecting the legs;

a plurality of horizontal platforms coupled to the frame and transverse to the at least two legs;

the plurality of horizontal platforms having a stepped configuration such that an upper platform is recessed compared to a lower platform;

a plurality of horizontal bars coupled to the frame and transverse to the at least two legs; and the plurality of horizontal bars having a stepped configuration such that an upper bar is recessed compared to a lower bar.

In a further aspect there is provided a method of performing a walking push-up comprising:

placing hands on a base surface;

placing at least one foot on an upper recessed bar;

moving both hands forward longitudinally;

moving at least one foot to a lower bar;

performing a push-up;

moving both hands backward longitudinally; and moving at least one foot to the upper recessed bar.

In a still further aspect there is provide a method of performing a walking push-up comprising:

placing hands on a base surface;

placing at least one foot on an elevated sliding bar that slides in a single dimension horizontal to the base surface;

moving both hands forward longitudinally;

performing a push-up; and moving both hands backward longitudinally.

DETAILED DESCRIPTION OF THE PREFERRED EMBODIMENT

Figure 1:
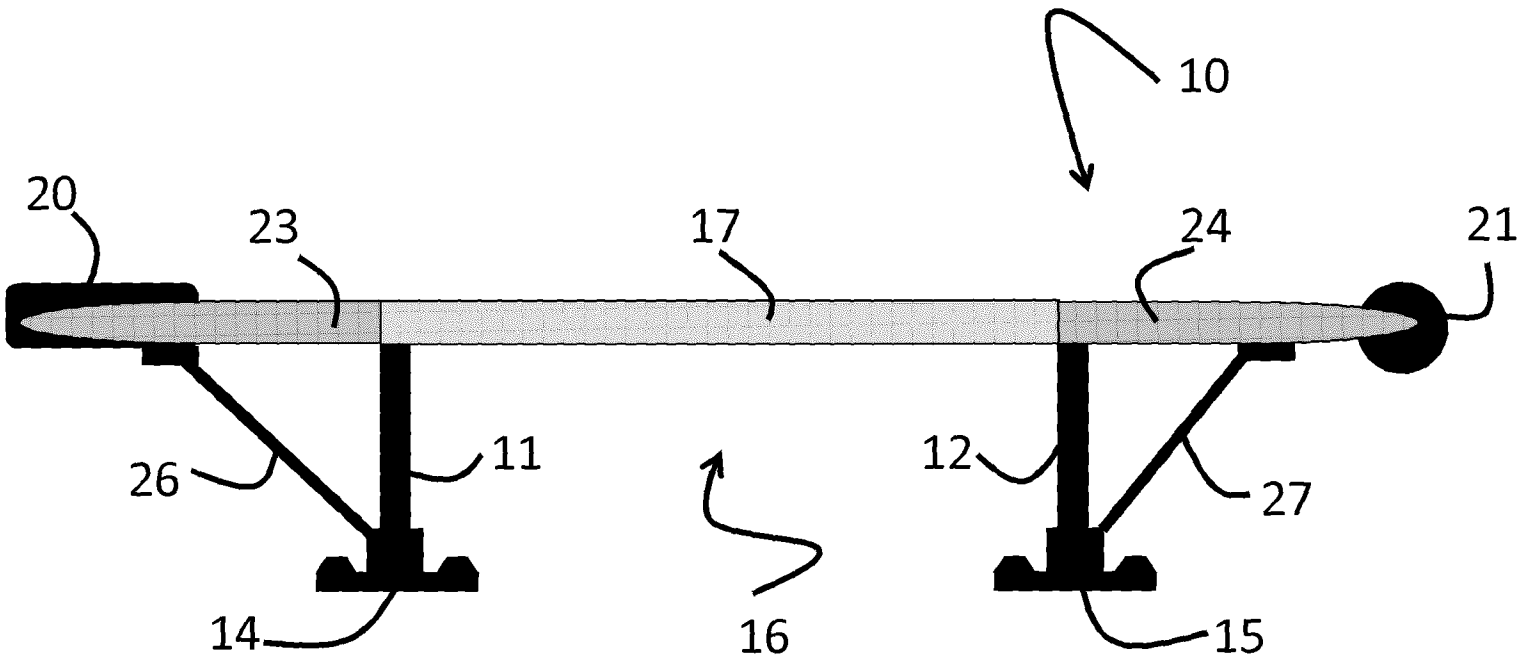
FIG. 1 shows a side view of a push-up exercise apparatus comprising a single padded platform and a single padded bar.

Now referring to the drawings, a push-up exercise apparatus will be described. Directional terms such as lower, upper, top, bottom, vertical, horizontal, and diagonal will be used to describe the push-up exercise apparatus, and such terms are meant to be interpreted in the context of the push-up exercise apparatus in operation on a horizontal base surface.

FIG. 1 shows a side view of push-up exercise apparatus 10 comprising a single padded platform 20 and a single padded bar 21. Both padded platform 20 and padded bar 21 are coupled to a frame 16 and are thereby elevated from a base surface.

The frame 16 comprises four vertical legs (only two vertical legs 11, 12 are shown) and four cross braces connecting the four vertical legs (only cross brace 17 connecting the vertical legs 11, 12 is shown). Each of the four cross braces is horizontal and transverse to a pair of vertical legs. Thus, each vertical leg is coupled to two cross braces.

An upper end of each vertical leg is coupled to two cross braces, while the lower end of each vertical leg includes a foot shaped for abutting support on a base surface. As shown in FIG. 1, vertical leg 11 at its lower end is attached to foot 14, and vertical leg 12 is attached to foot 15. Each foot can provide a large and stable contact with a base surface so that apparatus 10 is freestanding and transportable. Alternatively, one or more feet can include openings for fasteners such as bolts, rivets and the like so as to anchor apparatus 10 to a base surface. Furthermore, one or more feet can include an adjustable spacer for adjusting the height of the frame or to compensate for a slightly uneven base surface.

Padded platform 20 and padded bar 21 are coupled to the frame by mounting brackets connected to each end of the platform or the bar. More specifically, padded platform 20 is coupled to the frame 16 using a mounting bracket 23 and a first mounting bracket that is not shown, and padded bar 21 is coupled to the frame 16 using mounting bracket 24 and a second mounting bracket that is not shown. The mounting brackets 23 and 24 are supported by diagonal struts 26 and 27, respectively. The first and second mounting brackets (not shown) are similarly supported by diagonal struts. The diagonal struts are used to bolster the load bearing capacity of the mounting brackets and their connected platform 20 or bar 21. Typically, the load bearing capacity of each platform or bar is at least 100 pounds.

Figure 2:
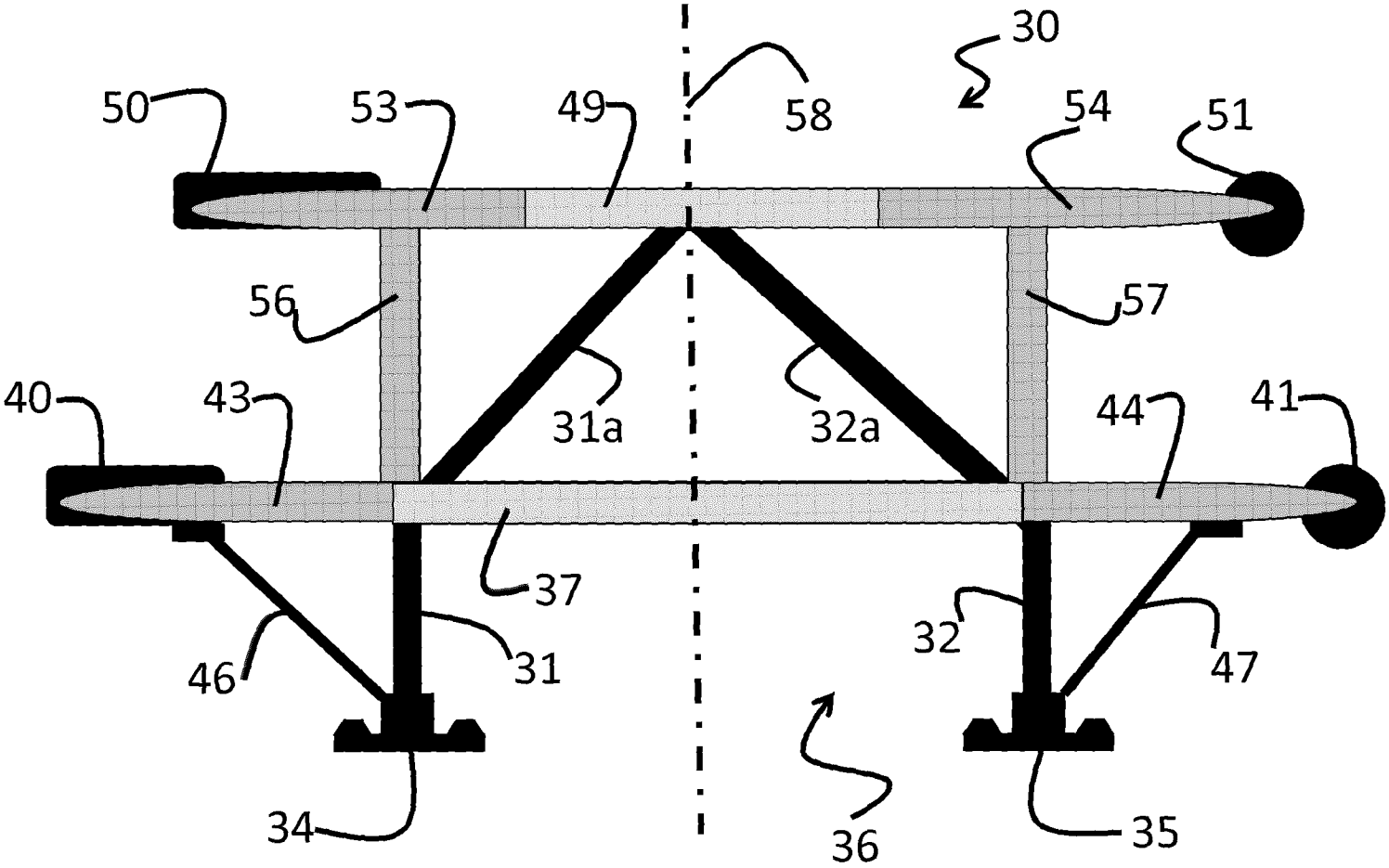
FIG. 2 shows a side view of a push-up exercise apparatus comprising two padded platforms and two padded bars.

FIG. 2 shows a side view of push-up exercise apparatus 30 comprising two padded platforms, a lower padded platform 40 and an upper padded platform 50, and two padded bars, a lower padded bar 41 and an upper padded bar 51. Both lower 40 and upper 50 padded platforms and both lower 41 and upper 51 padded bars are coupled to a frame 36 and both platforms and both bars are thereby elevated from a base surface.

The frame 36 comprises four vertical legs (only two vertical legs 31, 32 are shown) and four cross braces connecting the four vertical legs (only cross brace 37 connecting the vertical legs 31, 32 is shown). Each of the four cross braces is horizontal and transverse to a pair of vertical legs. Thus, each vertical leg is coupled to two cross braces.

Each of the vertical legs includes an angled portion. Above the point of contact with the cross braces each of the vertical legs is angled towards a plane of symmetry 58. Specifically, as shown in FIG. 2, the vertical legs 31 and 32 each include an angled portion 31*a* and 32*a*, respectively that connect at the vertical plane of symmetry 58. Since the angled portions 31*a* and 32*a* connect, vertical legs 31 and 32 may be manufactured as a single piece.

A lower end of each vertical leg includes a foot shaped for abutting support on a base surface. As shown in FIG. 2, vertical leg 31 at its lower end is attached to foot 34, and vertical leg 32 is attached to foot 35. Each foot can provide a large and stable contact with a base surface so that apparatus 30 is freestanding and transportable. Alternatively, one or more feet can include openings for fasteners such as bolts, rivets and the like so as to anchor apparatus 30 to a base surface. Furthermore, one or more feet can include an adjustable spacer for adjusting the height of the frame or to compensate for a slightly uneven base surface.

Padded platforms 40 and 50 and padded bars 41 and 51 are coupled to the frame 36 by mounting brackets connected to each end of the platform or the bar. More specifically, lower padded platform 40 is coupled to the frame 36 using mounting bracket 43 and a third mounting bracket that is not shown, and lower padded bar 41 is coupled to the frame 36 using mounting bracket 44 and a fourth mounting bracket that is not shown. The mounting brackets 43 and 44 are supported by diagonal struts 46 and 47, respectively. The third and fourth mounting brackets (not shown) are similarly supported by diagonal struts. The diagonal struts are used to bolster the load bearing capacity of the mounting brackets and their connected platform 40 or bar 41. Upper padded platform 50 is coupled to the frame 36 using mounting bracket 53 and a fifth mounting bracket that is not shown, and upper padded bar 51 is coupled to the frame 36 using mounting bracket 54 and a sixth mounting bracket that is not shown. The mounting brackets 53 and 54 are coupled to mounting brace 49 which in turn is coupled to the upper end of the vertical legs 31 and 32 at the connection point of angled portions 31*a* and 32*a*. Furthermore, the mounting brackets 53 and 54 are supported by vertical struts 56 and 57, respectively. The fifth and sixth mounting brackets (not shown) are similarly supported by vertical struts. The vertical struts are used to bolster the load bearing capacity of the mounting brackets and their connected platform 50 or bar 51. Typically, the load bearing capacity of each platform or bar is at least 100 pounds.

Padded platforms 40 and 50 and padded bars 41 and 51 are coupled to the frame 36 in a stepped configuration, such that lower padded platform 40 extends further away from plane of symmetry 58 of the frame than upper padded platform 50; similarly lower padded bar 41 extends further away from plane of symmetry 58 of the frame than upper padded bar 51. Alternatively, from a top view perspective upper padded platform 50 is recessed compared to lower padded platform 40, and upper padded bar 51 is recessed compared to lower padded bar 41.

Figure 3:
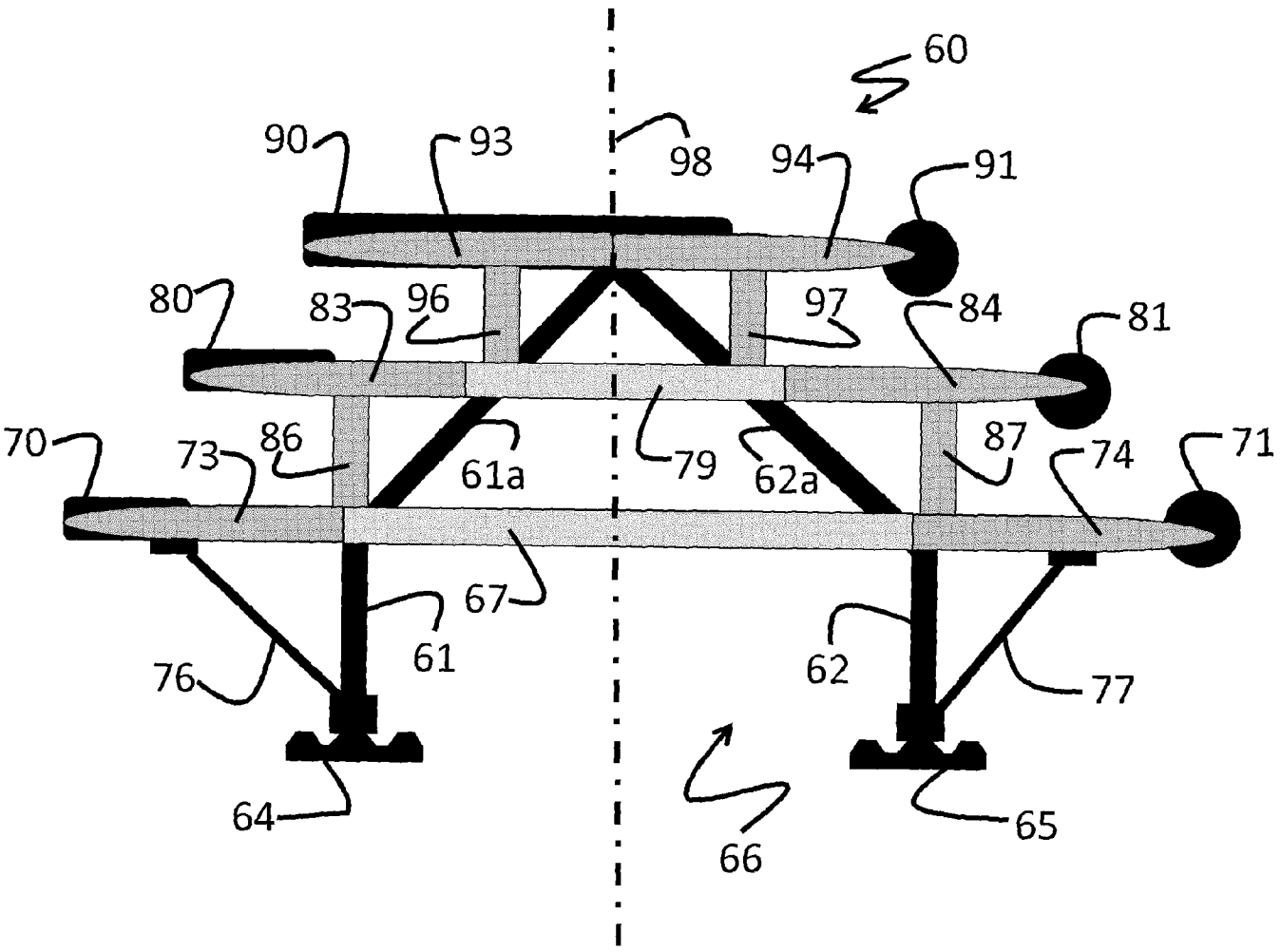
FIG. 3 shows a side view of a push-up exercise apparatus comprising three padded platforms and three padded bars.

FIG. 3 shows a side view of push-up exercise apparatus 60 comprising three padded platforms and three padded bars: a lower padded platform 70, a middle padded platform 80 and an upper padded platform 90, and a lower padded bar 71, a middle padded bar 81 and an upper padded bar 91. Each of the lower 70, middle 80 and upper 90 padded platforms and each of the lower 71, middle 81 and upper 91 padded bars are coupled to a frame 66 and all three platforms and all three bars are thereby elevated from a base surface. In some embodiments, the vertical displacement between each of the padded platforms and between each of the padded bars may be 6 inches to 12 inches. However, it is foreseeable that other embodiments may employ vertical displacement distances outside of this range.

The frame 66 comprises four vertical legs (only two vertical legs 61, 62 are shown) and eight cross braces connecting the four vertical legs (only lower cross brace 67 connecting the vertical legs 61, 62 and upper cross brace 79 connecting the angled portions 61*a*, 62*a* of vertical legs 61, 62 are shown). The eight cross braces can be categorized into two groups, lower cross braces and upper cross braces. Each of the four lower cross braces is horizontal and transverse to a pair of vertical legs. Each of the four upper cross braces is horizontal and transverse to the angled portions of a pair of vertical legs. Thus, each vertical leg is coupled to two lower cross braces and two upper cross braces. The angled portion of each of the vertical legs begins at the point of contact with the lower cross braces, and in these angled portions each of the vertical legs is angled towards a plane of symmetry 98. Specifically, as shown in FIG. 3, the vertical legs 61 and 62 each include an angled portion 61*a* and 62*a*, respectively connected at the vertical plane of symmetry 98. Since the angled portions 61*a* and 62*a* connect, vertical legs 61 and 62 may be manufactured as a single piece.

A lower end of each vertical leg includes a foot that is shaped for abutting support on a base surface. As shown in FIG. 3, vertical leg 61 at its lower end is attached to foot 64, and vertical leg 62 is attached to foot 65. Each foot can provide a large and stable contact with a base surface so that apparatus 60 is freestanding and transportable. Alternatively, one or more feet can include openings for fasteners such as bolts, rivets and the like so as to anchor apparatus 60 to a base surface. Furthermore, one or more feet can include an adjustable spacer for adjusting the height of the frame or to compensate for a slightly uneven base surface.

Padded platforms 70, 80 and 90 and padded bars 71, 81 and 91 are coupled to the frame 66 by mounting brackets connected to each end of the platform or the bar. More specifically, lower padded platform 70 is coupled to the frame 66 using mounting bracket 73 and a seventh mounting bracket that is not shown, and lower padded bar 71 is coupled to the frame 66 using mounting bracket 74 and an eighth mounting bracket that is not shown. The mounting brackets 73 and 74 are supported by diagonal struts 76 and 77, respectively. The seventh and eighth mounting brackets (not shown) are similarly supported by diagonal struts. The diagonal struts are used to bolster the load bearing capacity of the mounting brackets and their connected platform 70 or bar 71.

Middle padded platform 80 is coupled to the frame 66 using mounting bracket 83 and a ninth mounting bracket that is not shown, and middle padded bar 81 is coupled to the frame 66 using mounting bracket 84 and a tenth mounting bracket that is not shown. The mounting brackets 83 and 84 are coupled to upper cross brace 79 which in turn is coupled to the angled portions 61*a* and 62*a* of the vertical legs 61 and 62, respectively. Furthermore, the mounting brackets 83 and 84 are supported by vertical struts 86 and 87, respectively. The ninth and tenth mounting brackets (not shown) are similarly supported by vertical struts. The vertical struts are used to bolster the load bearing capacity of the mounting brackets and their connected platform 80 or bar 81.

Upper padded platform 90 is coupled to the frame 66 using mounting bracket 93 and an eleventh mounting bracket that is not shown, and upper padded bar 91 is coupled to the frame 66 using mounting bracket 94 and a twelfth mounting bracket that is not shown. The mounting brackets 93 and 94 are coupled to each other and to the upper end of the vertical legs 61 and 62 at the connection point of angled portions 61*a* and 62*a*. The mounting brackets 93 and 94 may be manufactured as one piece, and similarly the eleventh and twelfth mounting brackets (not shown) may be manufactured as one piece. Furthermore, the mounting brackets 93 and 94 are supported by vertical struts 56 and 57, respectively. The eleventh and twelfth mounting brackets (not shown) are similarly supported by vertical struts. The vertical struts are used to bolster the load bearing capacity of the mounting brackets and their connected platform 90 or bar 91. Typically, the load bearing capacity of each platform 70, 80 or 90 or each bar 71, 81, or 91 is at least 100 pounds.

Padded platforms 70, 80 and 90 and padded bars 71, 81 and 91 are coupled to the frame 66 in a stepped configuration, such that lower padded platform 70 extends further away from plane of symmetry 98 of the frame than middle padded platform 80 which in turn extends further away from plane of symmetry 98 of the frame than upper padded platform 90; similarly lower padded bar 71 extends further away from plane of symmetry 98 of the frame than middle padded bar 81 which in turn extends further away from plane of symmetry 98 of the frame than upper padded bar 91. Alternatively, from a top view perspective upper padded platform 90 is recessed compared to middle padded platform 80 which in turn is recessed compared to lower padded platform 70; similarly upper padded bar 91 is recessed compared to middle padded bar 81 which in turn is recessed compared to lower padded bar 71.

Figure 4:
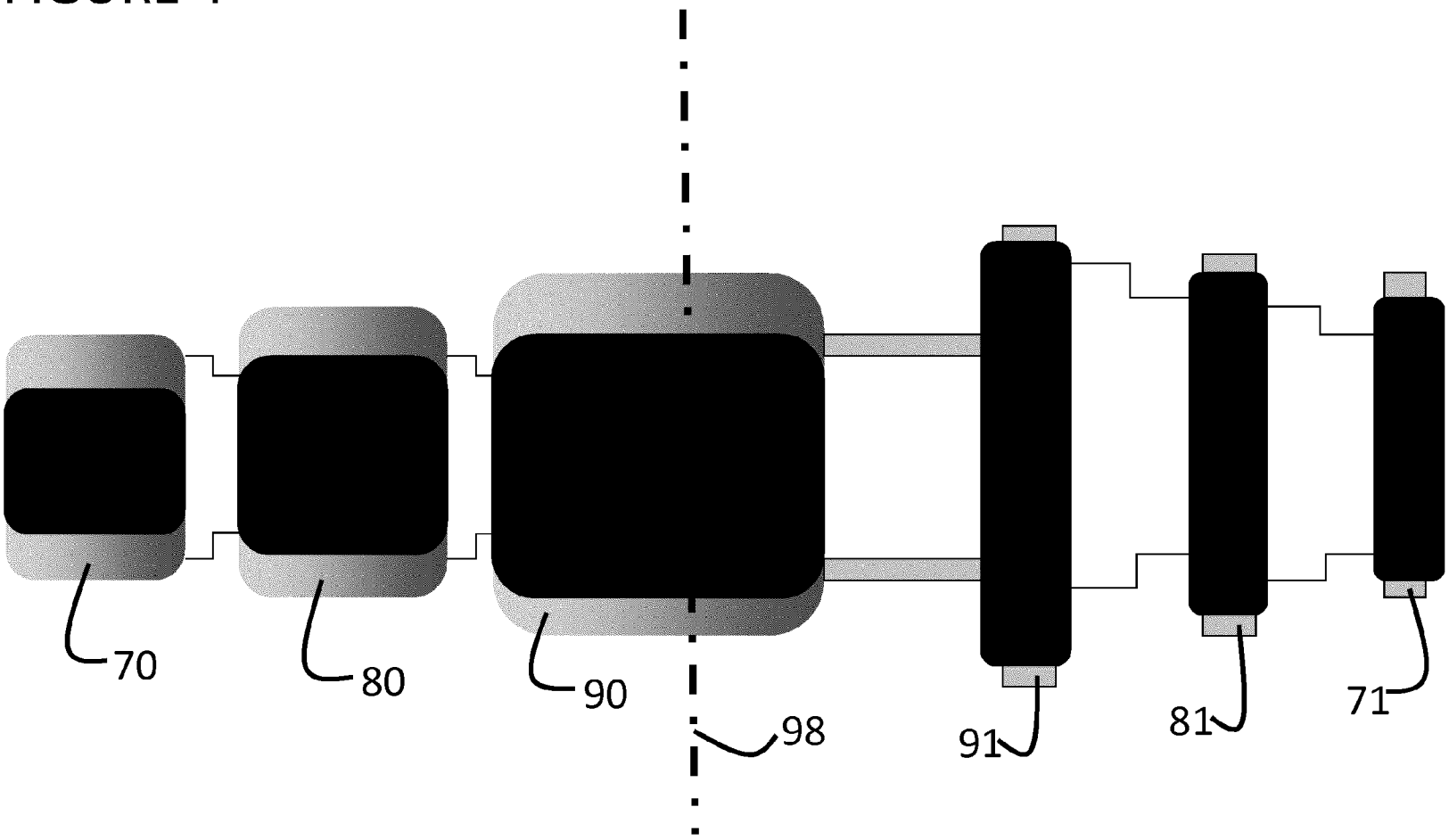
FIG. 4 shows a schematic top view of padded platforms and bars from the apparatus shown in FIG. 3.

FIG. 4 shows a top perspective view of the platforms 70, 80 and 90 and bars 71, 81, and 91 and their stepped spacing relative to the plane of symmetry 98 of the frame 66. The stepped spacing benefits users by allowing ease of access and full range of motion of a push-up exercise without unintended obstruction of a body part by a platform or bar. Furthermore, the stepped spacing allows users to perform a walking push-up, achieving longitudinal motion by moving from one platform or bar to a corresponding platform or bar above or below it. For example, in some embodiments the horizontal displacement of the stepped configuration may be 7 inches to 14 inches. However, it is foreseeable that other embodiments may employ horizontal displacement distances outside of this range while achieving the benefits of stepped spacing.

FIG. 4 also shows the surface area of platforms and bars covered by padding. The padding is useful in providing a secure and comfortable contact point with a user's body.

Figure 5:
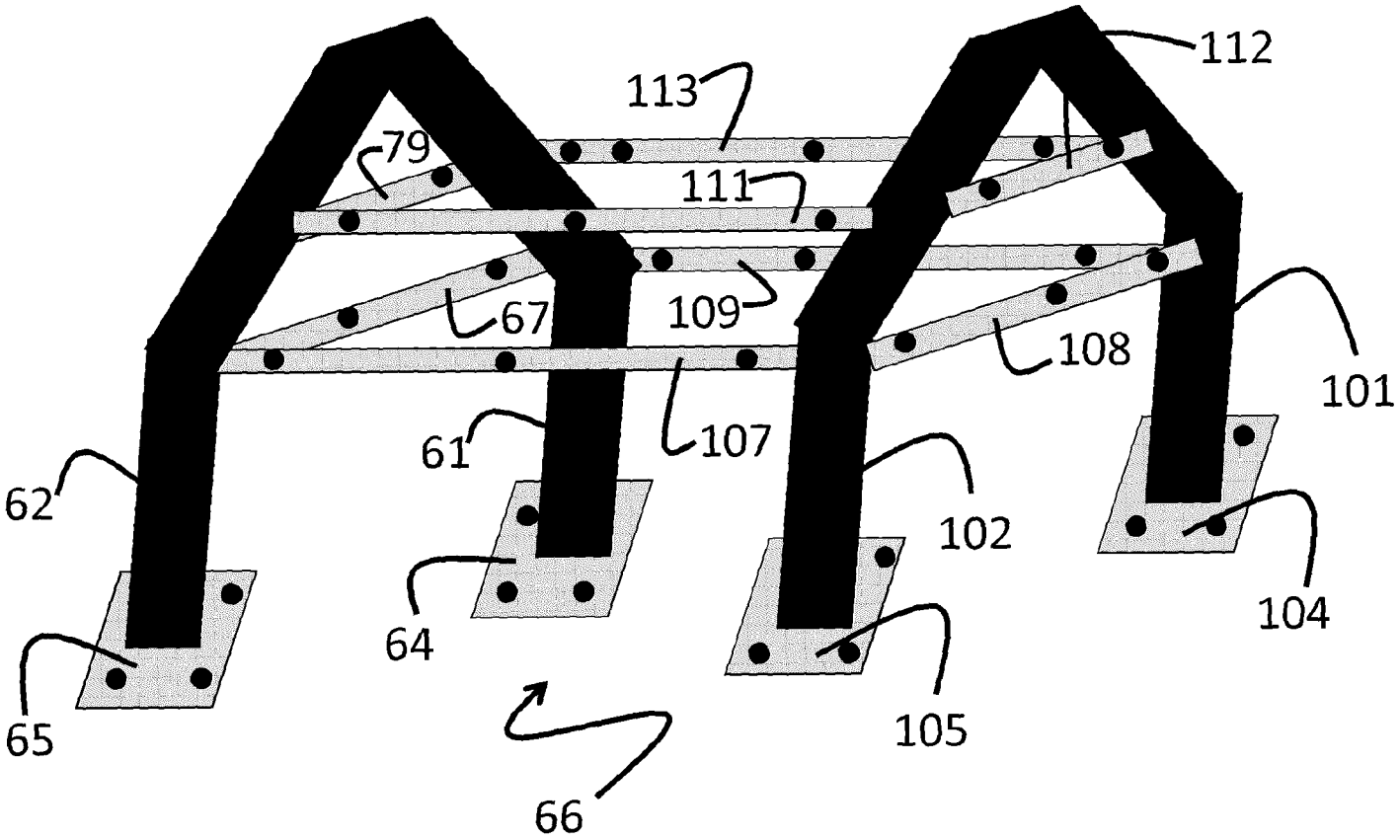
FIG. 5 shows a perspective view of a frame from the apparatus shown in FIG. 3.

FIG. 5 shows a perspective view of the frame 66 that is used in the push-up exercise apparatus 60 shown in FIG. 3. The frame 66 comprises four vertical legs 61, 62, 101 and 102 and eight cross braces connecting the four vertical legs. The eight cross braces can be categorized into two groups, lower cross braces 67, 107, 108 and 109 and upper cross braces 79, 111, 112 and 113. Each of the four lower cross braces is horizontal and transverse to a pair of vertical legs. Each of the four upper cross braces is horizontal and transverse to the angled portions of a pair of vertical legs. Thus, each vertical leg is coupled to two lower cross braces and two upper cross braces.

Four pairings of vertical legs can be identified in FIG. 5. Vertical legs 62 and 102 form a first pair and are connected by cross braces 107 and 111. Vertical legs 102 and 101 form a second pair and are connected by cross braces 108 and 112. Vertical legs 101 and 61 form a third pair and are connected by cross braces 109 and 113. Vertical legs 61 and 62 form a fourth pair and are connected by cross braces 67 and 79. Thus, each leg is part of two different leg pairings. For example, leg 102 is part of the first pair as well as the second pair. Vertical legs 61 and 62 may be manufactured as a single piece. Vertical legs 101 and 102 may also be manufactured as a single piece.

A lower end of each vertical leg includes a foot that is shaped for abutting support on a base surface. Vertical leg 61 at its lower end is attached to foot 64, vertical leg 62 is attached to foot 65, vertical leg 102 is attached to foot 105, and vertical leg 101 is attached to foot 104. Each foot provides a sufficiently large and stable contact with a base surface so that frame 66 is freestanding and transportable. Furthermore, each foot includes openings for fasteners such as bolts, rivets and the like so as to be able to anchor frame 66 to a base surface.

While mounting brackets were used to couple platforms and bars to frame 66 in FIG. 3, the perspective view of frame 66 shown in FIG. 5 makes clear that a suitable stepped configuration can be achieved by directly mounting padded platforms on cross braces 109 and 113, and directly mounting padded bars on cross braces 107 and 111. A cross brace and a platform may be manufactured as a single component. Similarly, a cross brace and a bar may be manufactured as a single component.

Figure 6:
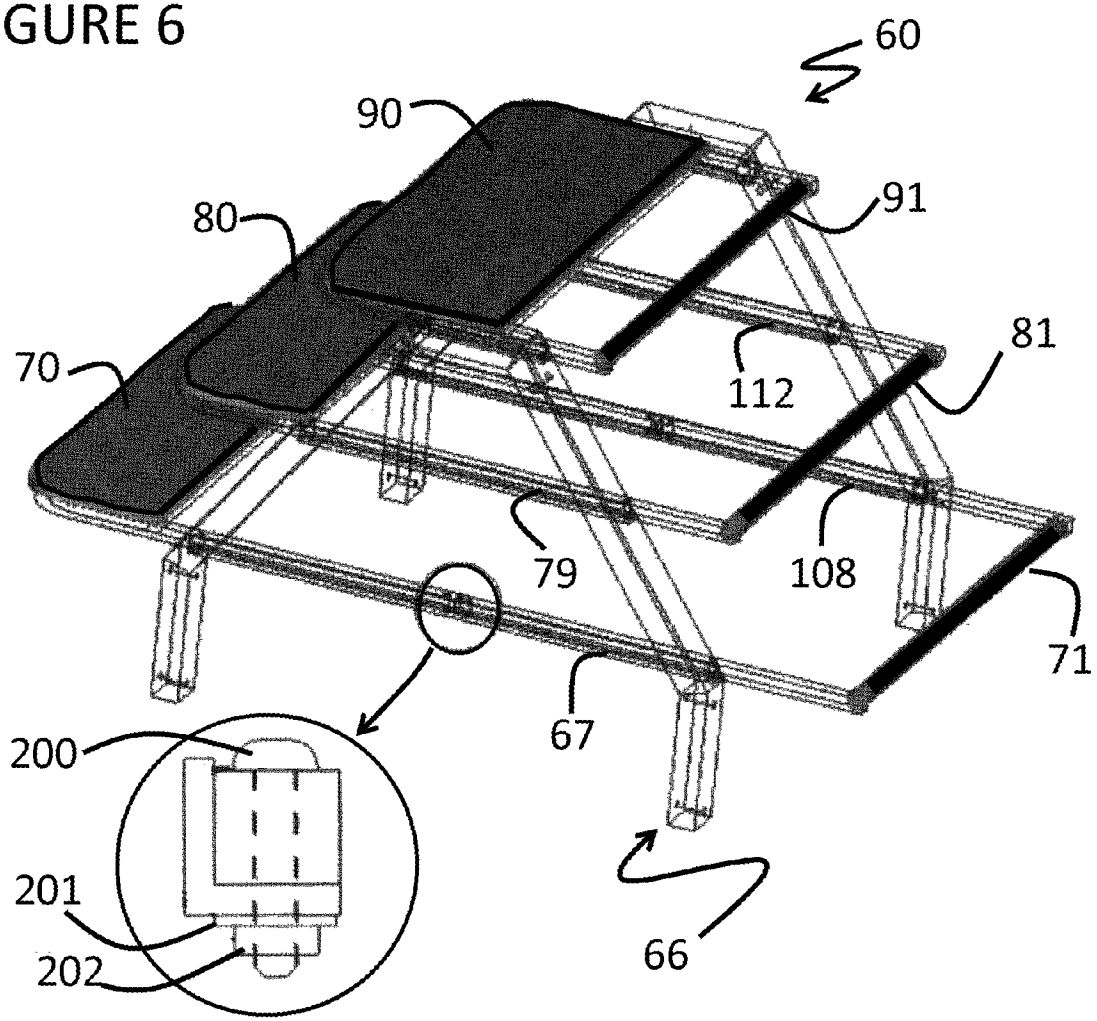
FIG. 6 shows a perspective view of the apparatus shown in FIG. 3 with a modification of the frame shown in FIG. 5.

FIG. 6 shows a perspective view of the apparatus 66 shown in FIG. 3 with a modification of frame 66 to remove cross braces 107, 109, 111 and 113 (shown in FIG. 5). A further modification is that the cross braces are manufactured as single components with mounting brackets, bars and/or supporting braces for platforms. More specifically, upper cross braces 79 and 112 are manufactured as a single component with bar 81 and a supporting brace for platform 80 and their respective pairs of mounting brackets. Similarly, the combination of lower cross braces 67 and 108, bar 71, supporting brace for platform 70, and their respective mounting brackets are manufactured as two halves that are joined at line of symmetry 98 (shown in FIG. 3) with bolt 200, washer 201 and locker 202.

Figure 7:
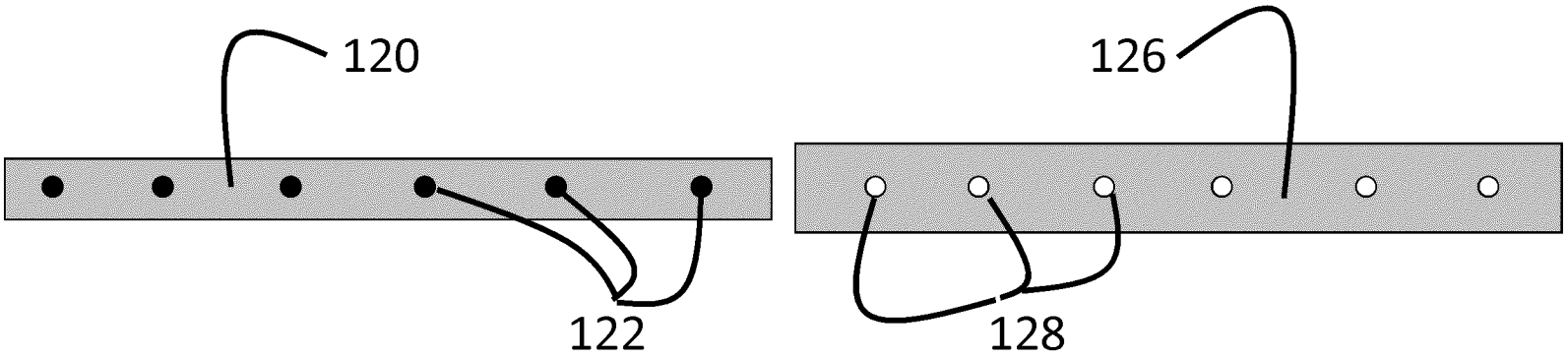
FIG. 7 shows a side view of a sliding mechanism adaptable to the push-up exercise apparatus described herein.

The padded platforms and bars shown in FIGS. 2 and 3 may be coupled to the frame by a sliding mechanism. An example of a sliding mechanism is shown in FIG. 7. Shaft 120 is coupled to a mounting bracket (not shown) and is received telescopically in chamber 126 which is coupled to a cross brace (not shown). Shaft 120 comprises one or more resilient projections 122 which can engage openings 128 in chamber 126 and act as a latch to incrementally lock the sliding mechanism. The interior of chamber 126 is lined with ball bearings to facilitate telescopic sliding of shaft 120.

Figure 8:
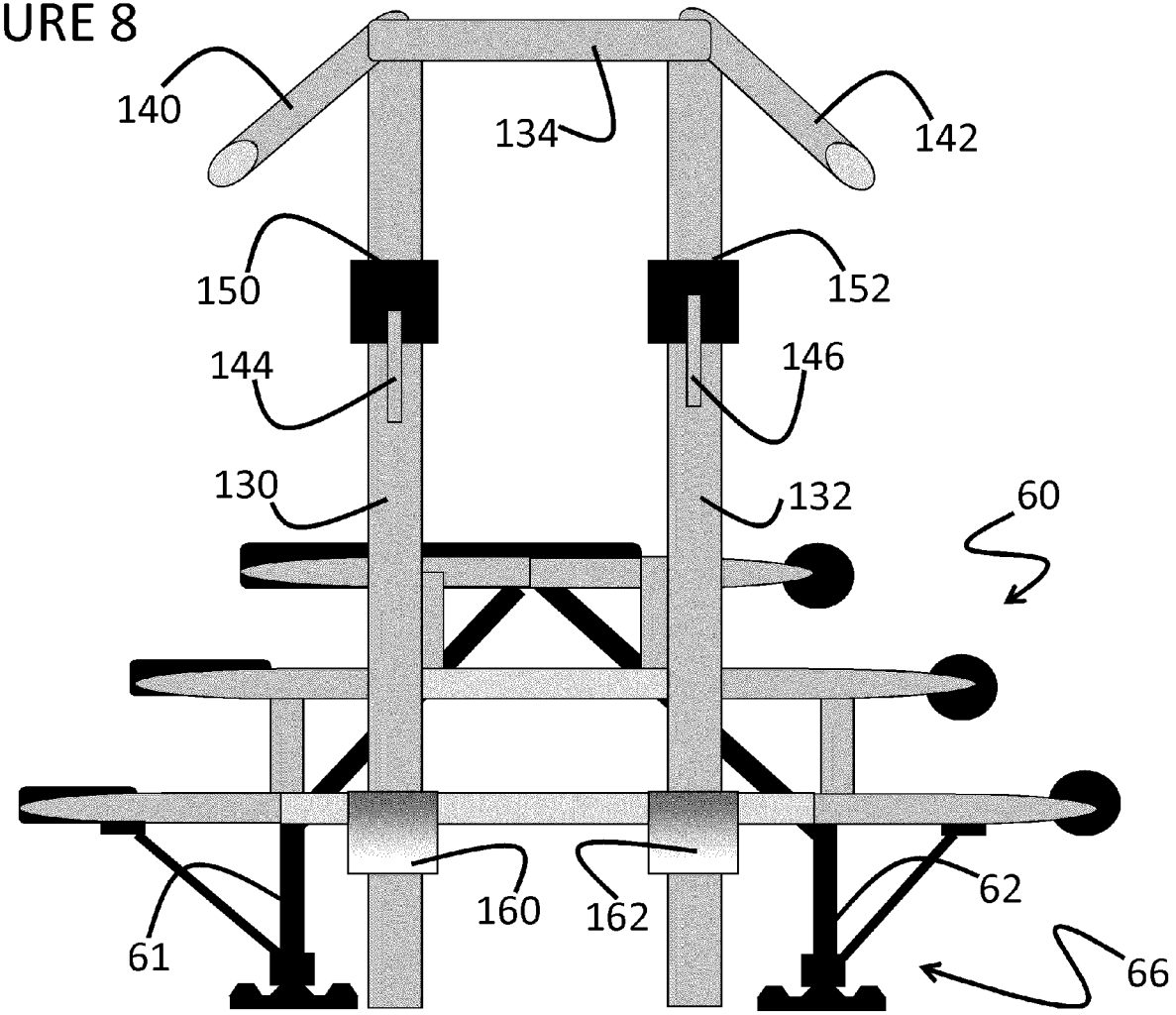
FIG. 8 shows a side view of the push-up exercise apparatus shown in FIG. 3 in combination with a device for chin-up, dip and leg raise exercises.

The push-up exercise apparatus described herein can be adapted to provide an exercise system for exercising the core muscles of the body. FIG. 8 shows apparatus 60 comprising two vertical parallel posts 130 and 132 mounted to the side of frame 66 defined by vertical legs 61 and 62. Vertical parallel posts 130 and 132 are connected by cross brace 134. Upper hand grips 140 and 142, lower hand grips 144 and 146, arm rests 150 and 152, and foot rests 160 and 162 are mounted on the parallel posts to allow for chin-up, dips, and leg raise exercising.

Figure 9:
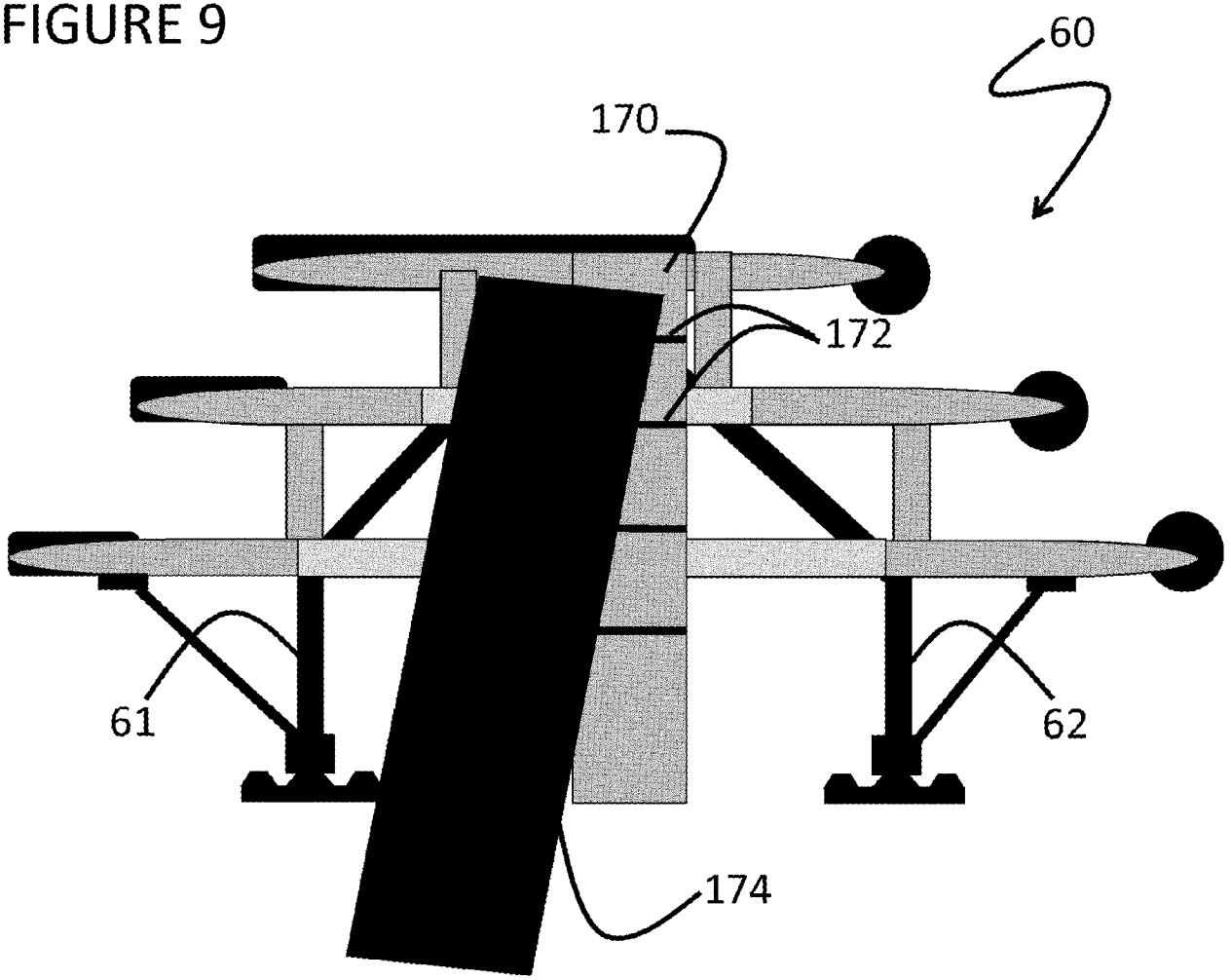
FIG. 9 shows a side view of the push-up exercise apparatus shown in FIG. 3 in combination with a device for sit-up exercises.

FIG. 9 shows apparatus 60 further comprising a vertical strip 170 coupled to the frame between vertical legs 61 and 62, the vertical strip 170 having a plurality of incremental slots 172 for reversibly coupling an end of a bottom side of a board 174, the top side of the board 174 comprising anchor points for feet to allow for sit-up exercises.

Combining the additional devices shown in FIGS. 8 and 9 such that apparatus 60 further comprises both chin-up, dip, and leg-raise device and an adjustable decline sit-up device provides an exercise system that allows for a comprehensive challenge of core muscles. Furthermore, anchor points such as hooks or rings for engaging elastic cables or bands may be provided at one or more points along frame 66. Working against the restorative force of stretched elastic cables or bands is the basis for many resistance training exercises and routines well known for challenging core muscles.

As shown in FIGS. 10 to 14 the push-up exercise apparatus may be provided on a two leg frame. FIG. 10A shows a two-legged push-up exercise apparatus 205 in an open operational lowered position, while FIG. 10B shows the apparatus 205 in a closed stored raised position. The apparatus 205 is moveable from an open position to a closed position by slidable coupling to a pair of vertical tracks, first vertical track 240 and second vertical track 241. The apparatus 205 comprises a pair of legs, a first leg 207 and a second leg 208. The pair of legs are substantially parallel and support mounting of three platforms 210, 220 and 230 and three bars 211, 221 and 231 in between the pair of legs. The three platforms are mounted in a stepped configuration with an upper platform recessed relative to a lower platform. Similarly, the three bars are mounted in a stepped configuration such that an upper bar is recessed relative to a lower bar.

Each of the pair of legs 207 and 208 comprise first and second ends. A first foot 244 is formed at the first end of the first leg 207. A second foot 246 is formed at the first end of the second leg 208. First foot 244 and second foot 246 provide abutting support on a horizontal base surface when apparatus 205 is in an open position. First foot 244 comprises roller 245 and second foot 246 comprises roller 247, with rollers providing gliding support along the horizontal base surface as the apparatus 205 is moved from a closed position to an open position.

Figure 11B:
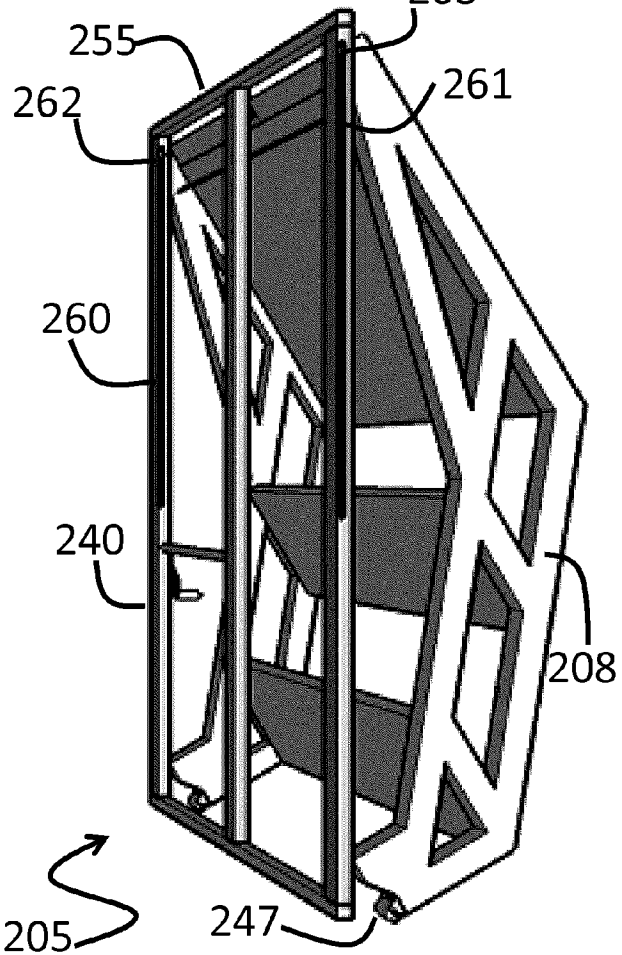
FIGS. 11A and 11B show a side perspective view of the apparatus shown in FIG. 10B from (11A) a front angle and (11B) a rear angle.
Figure 11A:
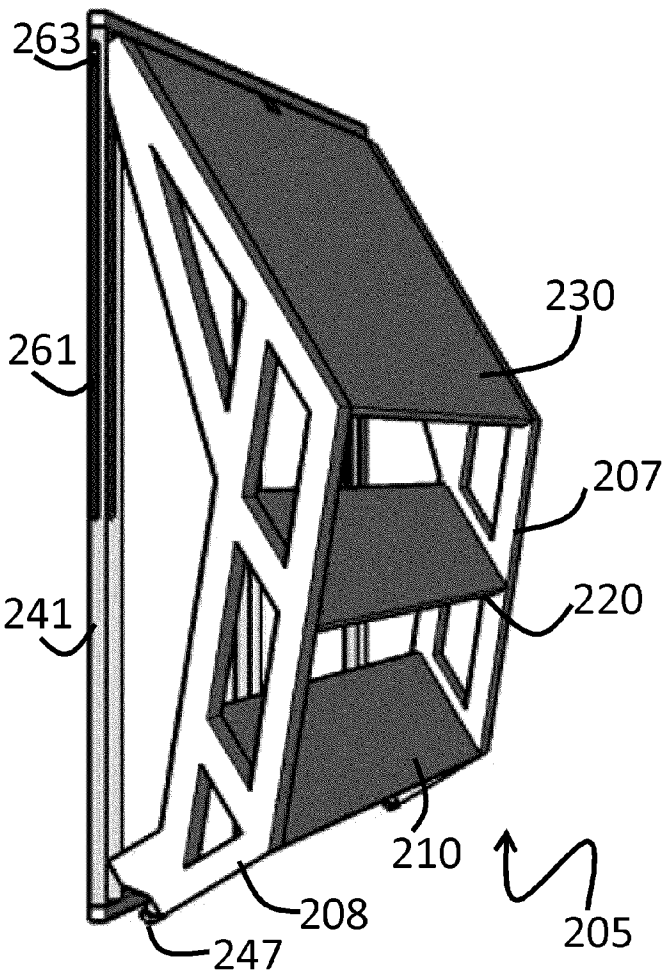
Figures 12A, 12B:
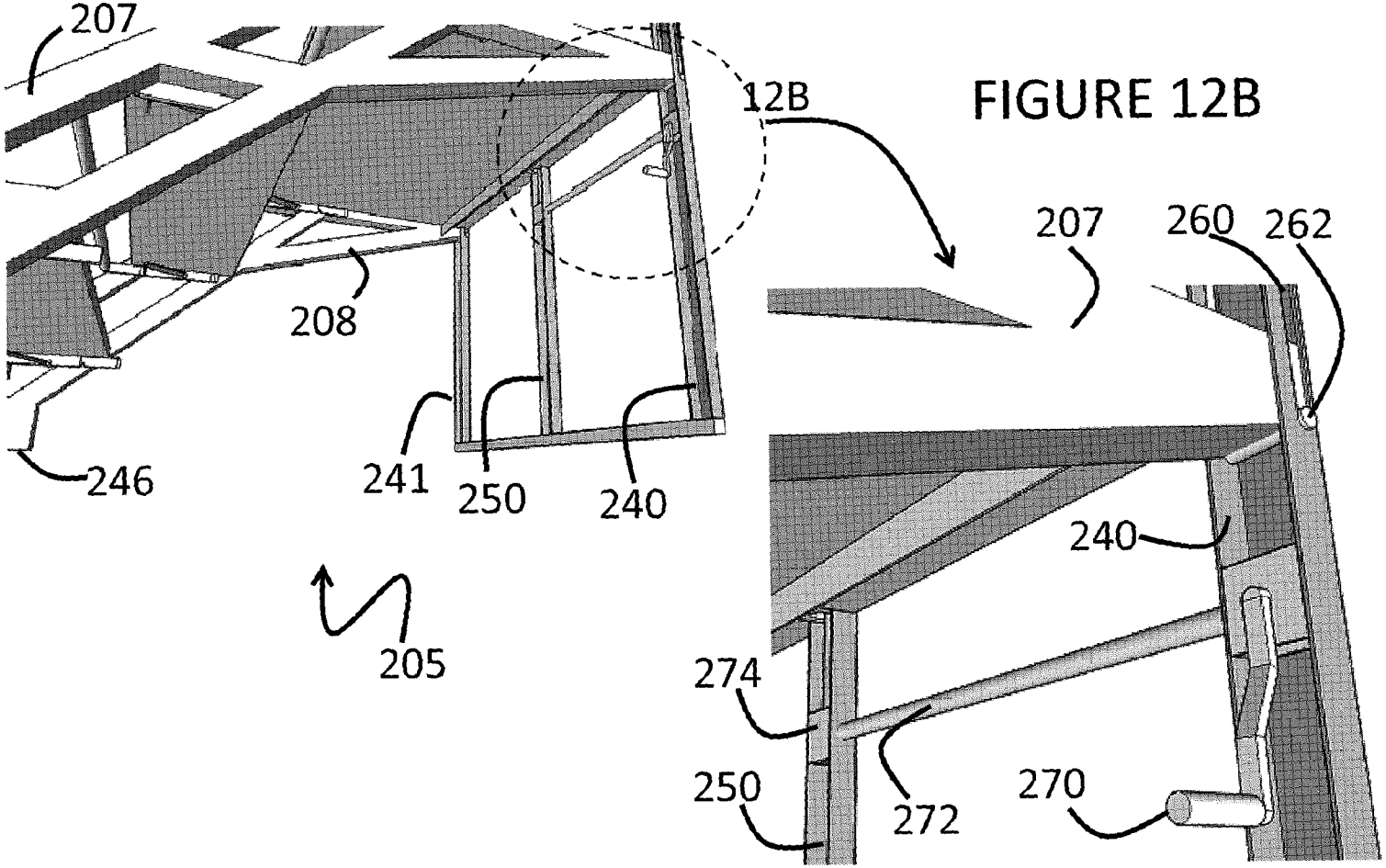
FIGS. 12A and 12B show a perspective view of a crank used to provide motive force to raise or lower the apparatus shown in FIG. 10.

As shown in FIGS. 11A and 11B a first bolt 262 is coupled to the second end of the first leg 207 and a second bolt 263 is coupled to the second end of the second leg 208. First bolt 262 slidably engages a first slot 260 formed in the first vertical track 240, while in parallel fashion the second bolt 263 slidably engages slot a second slot 261 formed in the second vertical track 241. First and second slots 260 and 261 are substantially parallel. A third vertical track 250 disposed between vertical tracks 240 and 241 houses a cable and pulley mechanism (not shown) to transmit motive force to move the apparatus 205 from an open position to a closed position. A first end of the cable is attached (not shown) to a cross-brace connecting substantially symmetrical points at or near the respective second ends of the first and second legs 207 and 208. A second end of the cable may be attached to a rotatable spool housed in casing 274 located within third vertical track 250. As shown in FIGS. 12A and 12B a crank 270 and spindle 272 mechanism communicative with the rotatable spool may be used to provide motive force to actuate the cable and pulley mechanism housed in third vertical track 250. The combination of the crank 270, spindle 272, rotatable spool and cable and pulley mechanism forms a winch to actuate movement of the apparatus 205 from an open position to a closed position. The crank 270 may be replaced by an electric motor communicative with spindle 272.

Figure 10B:
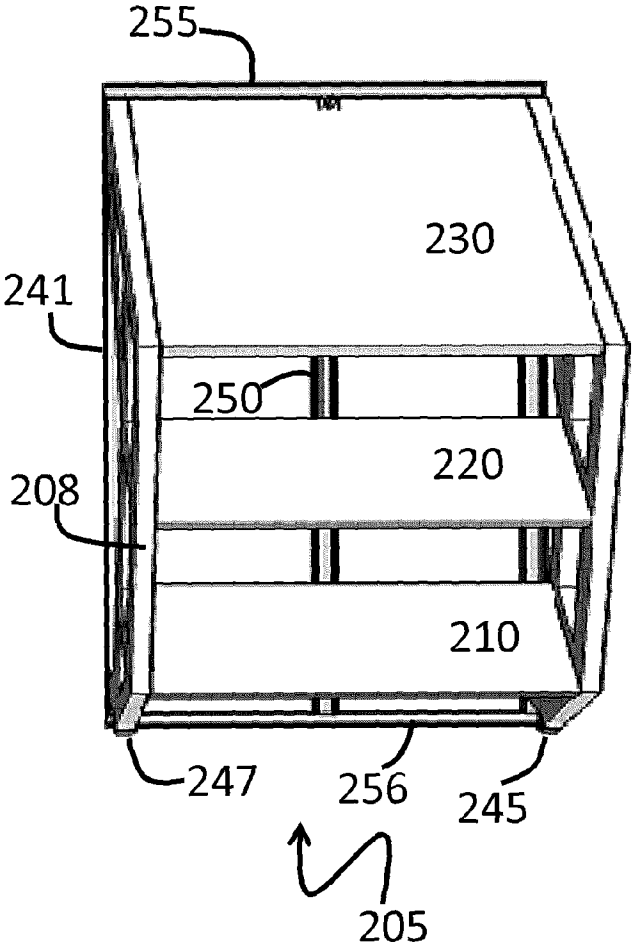
FIGS. 10A and 10B show a front perspective view of a variant push-up exercise apparatus in (10A) an open lowered position and (10B) a closed raised position.

Vertical tracks 240, 241 and 250 are connected by cross braces 255 and 256 (see FIG. 10B). One or more of vertical tracks 240, 241 and 250 and cross braces 255 and 256 may comprise apertures for receiving fasteners such as bolts, screws, rivets and the like. The vertical tracks and cross braces may be secured to a vertical base surface, typically a wall or vertical beams, using any convenient fastening mechanism.

Figure 13:
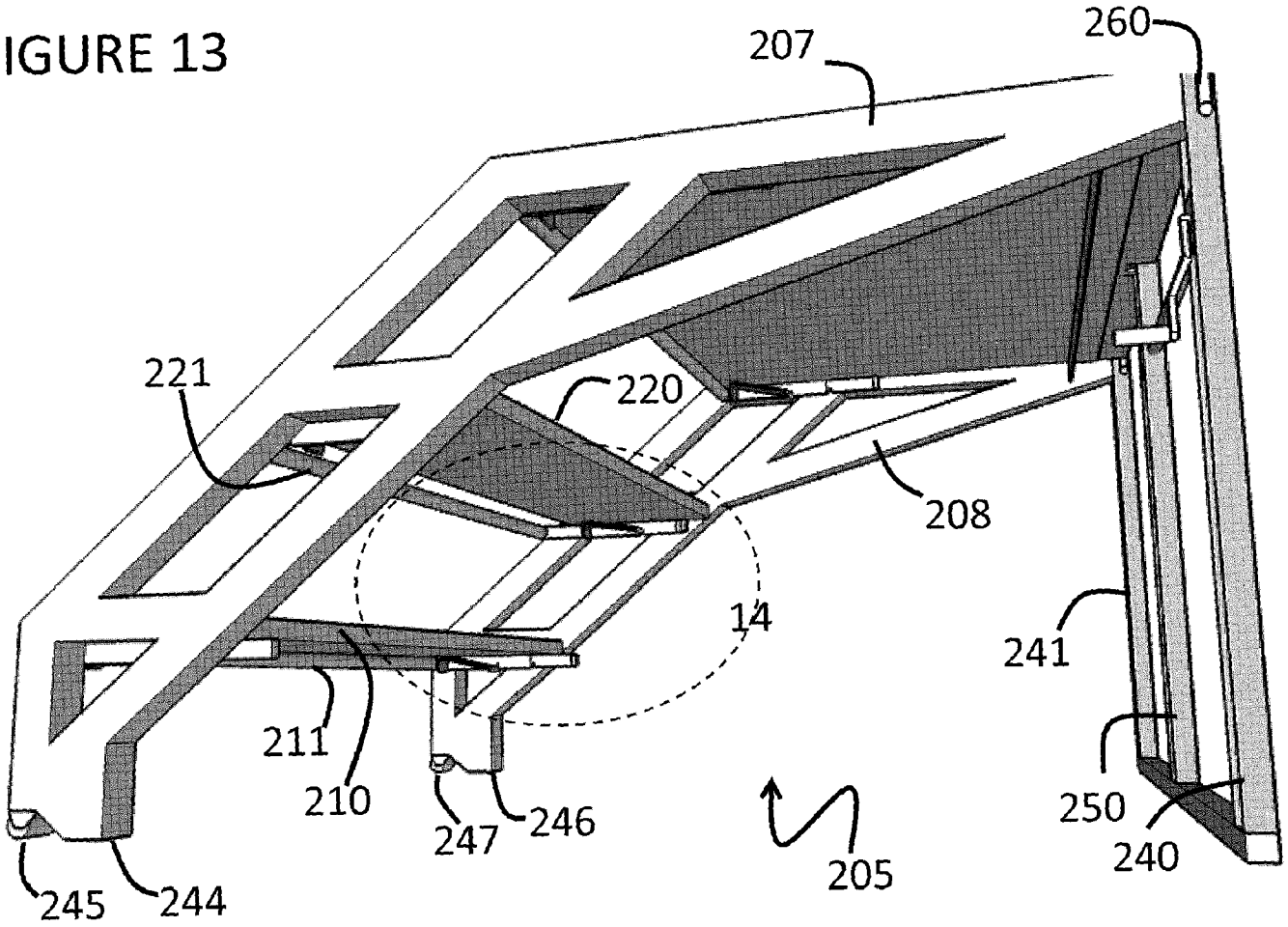
FIG. 13 shows a side and bottom angled perspective view of the apparatus shown in FIG. 10.
Figure 14:
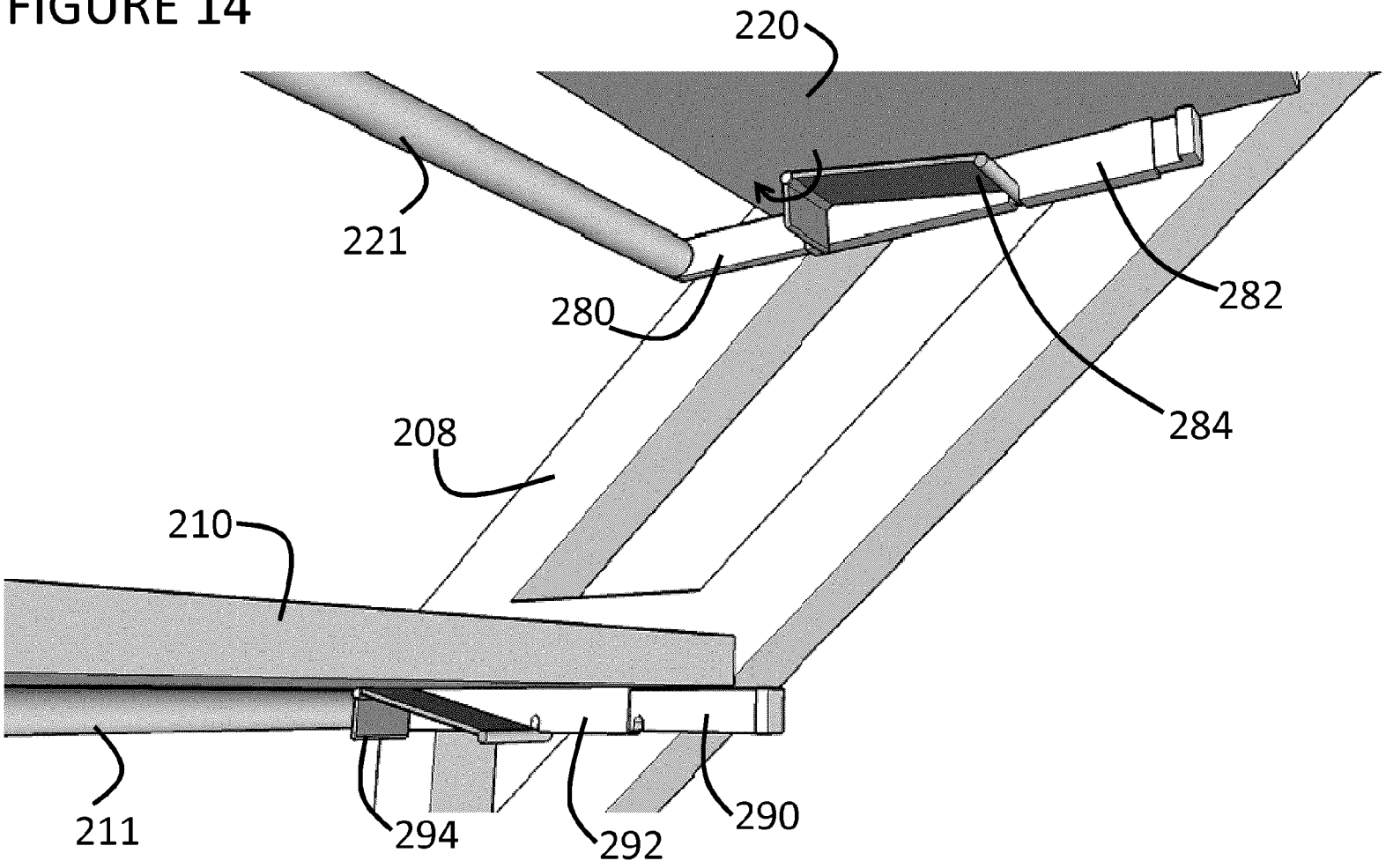
FIG. 14 shows a magnification of circle 14 marked in FIG. 13.

As shown in FIG. 13 each of the three bars 211, 221, and 231 of the apparatus 205 is slidably mounted to substantially symmetrical mounting points on first and second legs 207 and 208 underneath a bottom surface of platforms 210, 220 and 230, respectively. Each bar is slidable from a retracted position to an extended position. In FIG. 13 as well as magnified view of circle 14 shown in FIG. 14 bar 221 is in an extended position, while bar 211 is in a retracted position. In its extended position bar 221, is horizontally displaced from platform 220 and is not horizontally overlapped by platform 220. In its retracted position, bar 211 is overlapped by platform 210. A magnified view of a portion of the sliding mechanism mounted to the second leg 208 is shown in FIG. 14. Bar 211 is connected to shaft 280 that is slidably received in chamber 282. Both shaft 280 and chamber 280 define notches that align when bar 211 is in a fully extended position allowing pin latch 284 to engage both notches and lock bar 221 in an extended position. Pin latch 284 is biased to engage the aligned notches and requires manual manipulation to disengage pin latch 284 from the aligned notches. Pin latch 294 is shown in a disengaged position as a notch defined in shaft 290 is not aligned with a notch defined in chamber 292 that slidably receives shaft 290, due to bar 211 being in a retracted position. As bar 211 is moved from a retracted position to an extended position the notches align and pin latch 294 moves from a disengaged position to an engaged position to engage the aligned notches. Pin latches 284 and 294 are similarly constructed of two arms joined at a vertex, the vertex rotatably coupled to the chambers 282 and 292, respectively and aligned with the notches of the respective chambers. The rotation of the pin latches is spring biased towards engagement of the notches so that when the shaft and chamber notches align the pin latch rotates to an engaged position.

In operation, multiple types of modified push-ups may be performed using the push-up exercise apparatus described herein. To perform an incline push-up hands are placed on a platform or bar while feet are placed on the base surface. Conversely, to perform a decline push-up feet are placed on a platform or bar while hands are placed on the base surface.

Placement of hands or feet on a platform is more stable than placement on a bar. Therefore, inexperienced users can first perfect their push-up technique on a platform before performing push-ups on a corresponding bar. Experienced users that have perfected their technique on both platform and bar may choose to begin their routine with the bar and then switch to a corresponding platform as fatigue sets in.

The difference in stability between a platform and a bar provides a useful transition in an exercise routine, and therefore the push-up exercise apparatus will necessarily comprise at least one platform and at least one bar. Modifying a bar or platform so that it can be switched from a locked mode to a sliding mode can also create a difference in stability that provides a useful transition in an exercise routine.

Ideally, for every bar there may be a corresponding platform having a similar (ie., within approximately 6 inches) vertical height from the base surface. Having a corresponding platform and bar at substantially the same vertical height from the base surface is beneficial, but not critical to the proper function of the push-up exercise apparatus. For incline push-ups having a platform and a bar at the same vertical height allows for a more controlled transition from platform to bar as the user's angle of incline remains constant. For decline push-ups having a platform 1 to 2 inches lower than a corresponding bar (toes typically contact a platform, while the inner ankle and upper foot typically contacts a bar) allows for a more controlled transition from platform to bar as the user's angle of decline remains constant.

The push-up exercise apparatus described herein is for the development of a user's core strength through push-ups. The apparatus allows a user to perform a multitude of incline and decline push-ups. Furthermore, closed grip, normal grip and wide grip push-ups can be performed. The multi-level and multiple arm placement options afforded by the apparatus can benefit users of a wide range of experience. Moreover, a wide range of exercises other than push-ups such as elastic cable exercises, sit-ups, leg raises, jump-ups and the like may also be performed with the apparatus.

The apparatus described herein may benefit various aspects of the commercial gym and health industries. For example, many correctional institutions no longer have gyms due to troubles caused by free weights and removable parts. Since the apparatus described herein does not have removable parts, it would give the residents the ability to exercise without issue. The apparatus may benefit juveniles, as an increasingly recognized view is that no one under the age of 16 should be lifting weights as bone structure is not yet developed. Thus, schools can use the apparatus to help introduce fitness options while ensuring health and safety. Clients of the physiotherapy industry may also benefit from use of the apparatus as rebuilding of strength and balance of core muscles is an aspect of many rehabilitation programs. Further examples of target users of the apparatus include police stations, fire departments, army bases, hotels, condominiums, sports teams, martial arts and boxing studios, and dance studios.

Several variants of the push-up exercise apparatus have been described above. Further modifications and variants are contemplated. Non-limiting examples of further variants are now described.

As an example of a variant, modifications may be made to the foot (for example, FIG. 5 reference numerals 64, 65, 104, 105) at the lower end of each vertical leg shaped for abutting support on a base surface. As shown in FIG. 5, each vertical leg includes a defined foot. For additional stability the lower end of each vertical leg can connect with a continuous foot or base that may be continuous along the entire horizontal cross-section area of the frame or may be continuous along the entire periphery of the horizontal cross-section area of the frame. As well, a foot may be continuous between two legs. For example, in FIG. 10A a continuous horizontal bar may extend between foot 246 and foot 244.

In other variants, the sliding mechanism can be different than the telescopic slide shown in FIG. 7 or 14. Other sliding mechanisms may be used to achieve a sliding motion in a single dimension. For example, a platform or bar may be coupled to a mounting bracket with a ball or cylindrical bearing slide so that the platform or bar can slide along the length of the mounting bracket. Furthermore, latches, detent, and other features known to be used with sliding mechanisms may be incorporated as desired. A sliding platform or bar can increase the physical effort needed to perform a push-up compared to a corresponding stationary platform or bar, and thus may provide a useful transition in an exercise routine. Furthermore, a sliding platform or bar is useful for any push-up that involves longitudinal movement such as a walking push-up or a Hindu or Chinese push-up. A walking push-up using a sliding bar or platform involves placing hands on a base surface, placing feet on an elevated sliding bar or platform, moving both hands forward longitudinally, performing a push-up, and moving both hands backward longitudinally. Furthermore, as shown in FIGS. 13 and 14, a sliding mechanism to retract or extend a bar provides an organizational benefit to placing a bar and a platform in proximity on the same side of a frame.

In another variant, a sliding mechanism may be provided along the largest dimension of a bar or platform. For example, a sliding mechanism may be installed along a longitudinal direction of a bar or platform in between a pair of legs. The sliding mechanism comprises a pair of holders for supporting hands or feet slidably coupled for independent motion along the longitudinal direction of the bar or platform. The pair of holders may comprise a pair of sleeves slidably mounted on a bar, or a pair of foot/hand sized trays slidably mounted to a longitudinal track on a platform. Users may place hands/feet on the holders and symmetrically/asymmetrically slide in a repeated motion while in a push-up stance.

In another variant, the frame of the push-up exercise apparatus can be opened and rotated about a pivot joint. For example, the frame may comprise a pivot joint along a vertical plane of symmetry and the frame may be opened at least 90 degrees by rotation of the joint; or the frame may comprise a pivot joint and a reversible closure, the pivot joint and the reversible closure located on opposing portions of the frame, and the frame being opened at least 90 degrees by releasing the reversible closure and rotation of the joint.

In yet another variant, the platform may comprise anchor points for hands or feet to prevent slippage. For example, a flange or a rib running the width of the platform along its upper surface may be used. In a further, example the entire upper surface of the platform may comprise a set of parallel ribs running the width of the platform.

In other variants, the frame may comprise any number of legs provided that there are at least two different pairs of legs defining two different sides of the frame for coupling padded platforms and bars. A frame with three legs with the frame having a triangular horizontal cross-section comprises three different pairs of legs as each side of the triangular cross-section is defined by a different pair of legs. Similarly, a frame with four legs defining a quadrilateral horizontal cross-section comprises four different pairs of legs as each side of the quadrilateral horizontal cross-section is defined by a different pair of legs. In this manner, frames with three, four, five, six, seven or more sides may be used for coupling platforms or bars. In these variants, each leg is common to two different pairings of legs. Alternatively, multi-sided frames may be constructed with a unique pair of legs defining each side. For example, the apparatus shown in FIG. 10A absent the sliding wall tracks can be used to define each side of a multi-sided apparatus, such that each side is defined by a unique pair of legs. A multi-sided apparatus may form an open or closed shape in horizontal cross-section.

Figure 10A:
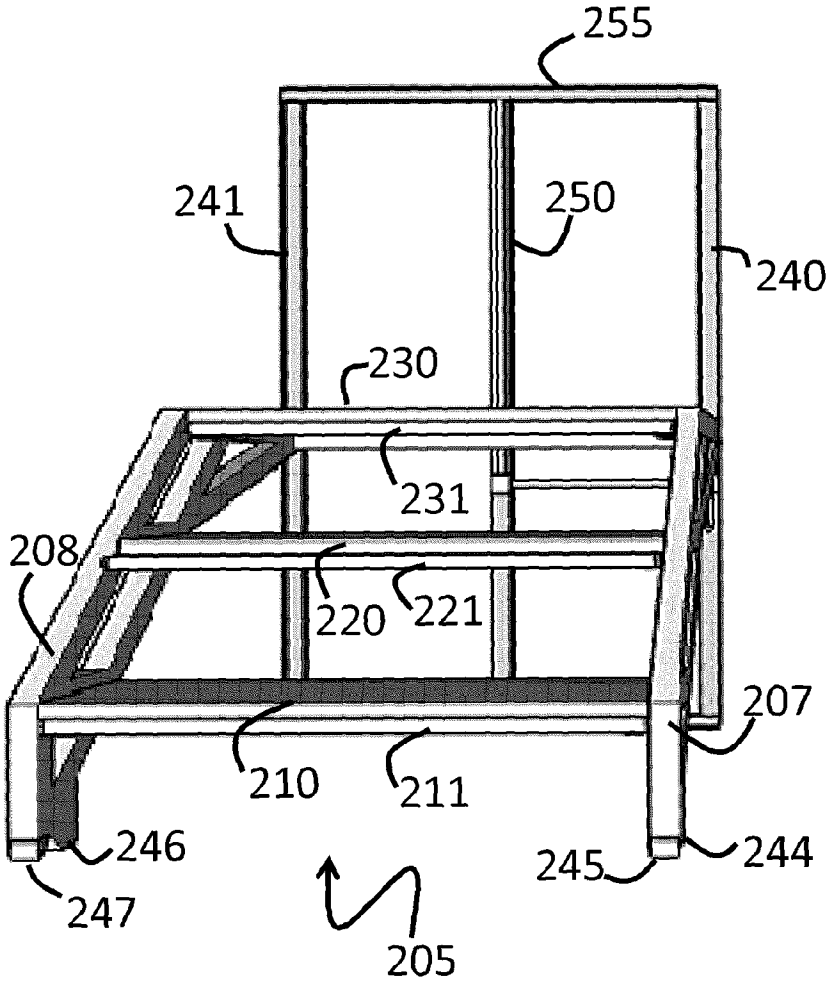

In other variants, the frame may comprise one or more legs. To understand a construction of a frame with one or two legs, a consideration of FIG. 10A is useful. The apparatus shown in FIG. 10A has two parallel legs with a series of stepped bars and a series of stepped platforms mounted between the two legs 207 and 208. This construction would be useful even if the two legs were fixedly mounted to the wall tracks 240 and 241, rather than slidably, and even if the bars were fixed in an extended position rather than slidably moveable relative to the plane defined between the two legs. Given that the apparatus shown in FIG. 10A modified to remove sliding motion can still be useful, a single leg version of the apparatus may be constructed with a central portion of each bar or each platform mounted to the single leg. While such a single legged version is possible, it will require an increase in manufacturing costs to achieve a load bearing capacity comparable to a platform or bar mounted between two legs.

The platform and bar are shown in the drawings as a horizontal platform and a horizontal bar, respectively. A padded platform is a platform having a padded surface. A padded bar is a bar having a padded surface. The platform and bar will typically be elongate and therefore each platform or bar will typically have a largest (longitudinal) dimension and smaller (lateral) dimensions. Any of the dimensions may be varied according to a specific application. The largest dimension (typically the length between two legs of a frame) of the platform or bar may be varied according to hand and feet placements for push-ups. For allowing a closed, diamond or standard shoulder width hand placement a width of at least 25 inches for the platform or bar is useful. To further include wider hand placements the width of the platform or bar can be extended to be greater than 30 inches, 35 inches, 40 inches, 45 inches, 50 inches or more. The smaller dimensions of the platform and bar (depth and thickness for a platform, diameter for a bar) may also be varied according to any desired criteria, such as load bearing capacity. The depth of the platform may range from 6 inches to 25 inches. The top platform may have a greater depth ranging from 10 inches to 25 inches. The lower platforms may have a lesser depth ranging from 6 inches to 15 inches. The thickness of the platform may range from 0.3 inches to 3 inches.

The dimensions of the bar and platform may be relationally defined. The largest dimension of a platform and a bar may typically be substantially equal with a typical distance of at least 25 inches. The smaller dimensions of the platform (more specifically depth of the platform that runs transverse to a plane defined between two legs) will typically be of greater distance compared to the diameter of the bar. Generally, to provide a noticeable difference of support for foot and hand placements between a platform and bar, the depth of the platform may be at least 3 times greater than the diameter of a bar. The thickness of a platform may be varied independent of the diameter of the bar, and therefore the thickness of the platform may be less than, greater than or equal to the diameter of the bar. The relative difference in the depth dimension of the platform compared to the diameter of the bar may also be expressed with respect to surface area such that the surface area of the platform is typically at least 3 times greater than the surface area of the bar.

In the drawings, for example FIGS. 3, 9 and 11A, the depth of the top (third) platform is shown to be greater than the depth of the lower (first and second) platforms, such that the surface area of the top platform is more than double the surface area of a lower platform. The relatively larger surface area of the top platform allows for further training exercises such as sit up and crunches to be performed with feet of the trainee unsupported by a base surface. The relative depth and surface area of the platforms may be altered as desired.

While a series of two or more platforms or a series of two or more bars will be coupled to a frame in a stepped configuration, the horizontal and vertical displacement of a lower platform to an upper platform or a lower bar to an upper bar may be varied according to each application. Typically, a vertical displacement as measured between equivalent points on a lower platform and an upper platform or as measured between equivalent points on a lower bar and an upper bar will be greater than about 6 inches. Similarly, a horizontal displacement as measured between equivalent points on a lower platform and an upper platform or as measured between equivalent points on a lower bar and an upper bar will typically be greater than about 6 inches. Several examples of vertical displacement may range between 6 inches to 12 inches, while several examples of horizontal displacement may range between 7 inches to 14 inches.

The load bearing capacity of the platform or bar may be varied. A load bearing capacity of at least 100 pounds is recommended. For further robustness, platform and bars may be designed to have a load bearing capacity greater than 125 pounds, 150 pounds, 175 pounds, 200 pounds, 250 pounds or more.

The padding of the platform or bar may be varied. For example, neoprene, rubber, nylon or blends thereof may be used. Pads with or without cushioning may be used. The padding may be of any desired thickness.

Any desired number of anchor points such as rings, hooks, clips and the like for engaging elastic cables or bands may be mounted on the frame. Furthermore, the bars may be used for engaging elastic cables or bands.

The apparatus may be manufactured in combination with existing constructions of core muscle exercise devices such as devices for pull ups, dips, leg raises, sit ups and the like. Any number or types of devices may be attached to sides of the frame that do not support bars or platforms.

The use of the apparatus can extend beyond push-ups. For example, both forward and reverse lunges can be performed transitioning between the bars and the platforms. The platforms can be used for jump-ups and speed stepping exercises. Another example of an alternative exercise entails the trainee running or walking away from the bars against a restorative force of an elastic cable linked to both the bar and the trainee. The top platform is conveniently used for leg raises, jack-knife sit-ups and sit-ups with feet hooked under the top bar. Elastic bands wrapped around the bars with ends of the band held in the trainee's hands can provide resistance for bicep curl or tricep extension exercises. A multitude of other exercises can be performed and designed using the apparatus. Accordingly, training programs may be designed using the apparatus as a multi-functional exercise apparatus.

Further variants, modifications and combinations thereof will be apparent to a person of skill in the art.

What is claimed is:

1. A push-up exercise apparatus comprising:

a frame comprising at least 3 vertical legs and transverse cross braces connecting the legs;

the frame having a horizontal cross-section of at least 3 sides;

a plurality of horizontal platforms coupled to a first side of the frame and transverse to a first pair of legs of the at least 3 vertical legs;

the plurality of horizontal platforms having a stepped configuration such that an upper platform is recessed compared to a lower platform;

a plurality of horizontal bars coupled to a second side of the frame and transverse to a second pair of legs of the at least 3 vertical legs;

the plurality of horizontal bars having a stepped configuration such that an upper bar is recessed compared to a lower bar;

the surface area of each of the plurality of horizontal platforms is at least 3 times greater than the surface area of each of the plurality of horizontal bars;

at least one of the plurality of horizontal bars coupled to the frame by a sliding mechanism, the at least one of the plurality of horizontal bars sliding from a retracted position to an extended position, the extended position horizontally displaced from the retracted position, and the extended position horizontally displaced from both legs of the second pair of legs.

2. The push-up exercise apparatus of claim 1, wherein the largest dimension of each horizontal platform of the plurality of horizontal platforms is substantially the same as the largest dimension of each horizontal bar of the plurality of horizontal bars.

3. The push-up exercise apparatus of claim 1, wherein at least one horizontal platform of the plurality of horizontal platforms is coupled to the frame at substantially the same vertical height as at least one horizontal bar of the plurality of horizontal bars.

4. The push-up exercise apparatus of claim 1, wherein at least a portion of each of the vertical legs in the first pair of legs and the second pair of legs is angled towards a vertical plane of symmetry of the frame.

5. The push-up exercise apparatus of claim 1, wherein each leg of the first pair of legs and the second pair of legs includes a foot shaped for abutting support on a base surface, and each foot includes an opening for receiving a fastener for anchoring the foot to the base surface.

6. The push-up exercise apparatus of claim 1, wherein the sliding mechanism is symmetrically mounted to both legs of the second pair of legs.

7. The push-up exercise apparatus of claim 1, wherein the sliding mechanism is telescopic.

8. The push-up exercise apparatus of claim 1, wherein the sliding mechanism comprises a chamber telescopically receiving a shaft and a latch to switch the sliding mechanism from a sliding mode to a locked mode.

9. The push-up exercise apparatus of claim 1, wherein at least one of the plurality of horizontal platforms is coupled to the frame by a sliding mechanism, the at least one of the plurality of horizontal platforms slides from a retracted position to an extended position, and the extended position is horizontally displaced from the retracted position.

10. The push-up exercise apparatus of claim 1, wherein the plurality of horizontal platforms are padded and the plurality of horizontal bars are padded.

11. A push-up exercise apparatus comprising:

a frame comprising at least two legs and transverse cross braces connecting the legs;

a plurality of horizontal platforms coupled to the frame and transverse to the at least two legs;

the plurality of horizontal platforms having a stepped configuration such that an upper platform is recessed compared to a lower platform;

a plurality of horizontal bars coupled to the frame and transverse to the at least two legs;

the plurality of horizontal bars having a stepped configuration such that an upper bar is recessed compared to a lower bar;

the surface area of each of the plurality of horizontal platforms is at least 3 times greater than the surface area of each of the plurality of horizontal bars;

at least one of the plurality of horizontal bars coupled to the frame by a sliding mechanism, the at least one of the plurality of horizontal bars sliding from a retracted position to an extended position, the extended position horizontally displaced from the retracted position, and the extended position horizontally displaced from both legs of the at least two legs.

12. The push-up exercise apparatus of claim 11, wherein the largest dimension of each horizontal platform of the plurality of horizontal platforms is substantially the same as the largest dimension of each horizontal bar of the plurality of horizontal bars.

13. The push-up exercise apparatus of claim 11, wherein at least one horizontal platform of the plurality of horizontal platforms is coupled to the frame at substantially the same vertical height as at least one horizontal bar of the plurality of horizontal bars.

14. The push-up exercise apparatus of claim 11, wherein each leg of the at least two legs includes a foot shaped for abutting support on a base surface, and each foot includes an opening for receiving a fastener for anchoring the foot to the base surface.

15. The push-up exercise apparatus of claim 11, wherein the sliding mechanism is symmetrically mounted to both legs of the at least two legs.

16. The push-up exercise apparatus of claim 11, wherein the sliding mechanism is telescopic.

17. The push-up exercise apparatus of claim 11, wherein the sliding mechanism comprises a chamber telescopically receiving a shaft and a latch to switch the sliding mechanism from a sliding mode to a locked mode.

18. The push-up exercise apparatus of claim 11, wherein the retracted position places the at least one of the plurality of horizontal bars in horizontal overlap with one of the plurality of horizontal platforms, and the extended position horizontally displaces the at least one of the plurality of horizontal bars to not horizontally overlap with the one of the plurality of the horizontal platforms.

19. The push-up exercise apparatus of claim 11, wherein at least one of the plurality of horizontal platforms is coupled to the frame by a sliding mechanism, the at least one of the plurality of horizontal platforms slides from a retracted position to an extended position, and the extended position is horizontally displaced from the retracted position.

20. The push-up exercise apparatus of claim 11, wherein the plurality of horizontal platforms are padded and the plurality of horizontal bars are padded.

* * * * *